US006340028B1

(12) United States Patent
Hirai et al.

(10) Patent No.: US 6,340,028 B1
(45) Date of Patent: Jan. 22, 2002

(54) PICKLING DEVICE

(75) Inventors: Etsuro Hirai; Takumi Furuya; Masato Saka; Nobuyuki Taniguchi, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/402,896

(22) PCT Filed: Mar. 5, 1999

(86) PCT No.: PCT/JP99/01059

§ 371 Date: Oct. 13, 1999

§ 102(e) Date: Oct. 13, 1999

(87) PCT Pub. No.: WO99/46426

PCT Pub. Date: Sep. 16, 1999

(30) Foreign Application Priority Data

Mar. 11, 1998 (JP) ..... 10-59306

(51) Int. Cl.[7] ..... B08B 3/04

(52) U.S. Cl. ..... 134/122 R; 134/64 R; 134/82; 134/199

(58) Field of Search ..... 139/64 R, 122 R, 139/64 P, 122 P, 199, 82

(56) References Cited

U.S. PATENT DOCUMENTS

| | | | | |
|---|---|---|---|---|
| 1,623,537 A | * | 4/1927 | Hill | |
| 2,162,692 A | * | 6/1939 | Baily | |
| 2,234,593 A | * | 3/1941 | Ferm et al. | |
| 2,628,627 A | * | 2/1953 | Huff | |
| 3,552,404 A | * | 1/1971 | Kuhn | |
| 3,625,232 A | * | 12/1971 | Speelamnns et al. | |
| 4,391,692 A | * | 7/1983 | Mindt | |

FOREIGN PATENT DOCUMENTS

| | | | | |
|---|---|---|---|---|
| DE | 3000408 A | | 7/1981 | |
| EP | 058216 A | | 8/1982 | |
| EP | 0795629 A | | 9/1997 | |
| FR | 2680181 A | | 2/1993 | |
| JP | 50-37612 | * | 12/1975 | ..... 134/122 R |
| JP | 2-133589 | * | 5/1990 | ..... 134/122 R |
| JP | 2133589 | | 5/1990 | |
| JP | 5 78870 | | 3/1993 | |
| JP | 08176868 A | | 7/1996 | |
| WO | 88 01657 | | 3/1988 | |

* cited by examiner

*Primary Examiner*—Randy Gulakowski

(57) ABSTRACT

An acid pickling tank 11 is filled with an acid liquid L, and a lid 12 is attached to the acid pickling tank 11. A central part of the lid 12 is depressed downwards to form a covering portion 12*b*. The covering portion 12*b* is located at a lower position than the liquid level of the acid liquid L in the acid pickling tank 11 to cover a free surface of the acid liquid L. Immersion guide rolls 20*a* to 20*e* are provided on the covering portion 12*b*, support blocks 21*a* to 21*e* are provided at the bottom of the acid pickling tank 11, and skids 23*a* to 23*e* are provided on the support blocks 21*a* to 21*e* via a bottom plate 22. Thus, the free surface of the acid liquid L in the acid pickling tank 11 is decreased to suppress a loss of the acid, and prevent an overflow of the acid liquid L to the outside of the tank, thereby making acid pickling of the strip steel plate S efficient.

4 Claims, 5 Drawing Sheets

Acid pickling device of first embodiment

PICKLING DEVICE

This application is the national phase under 35 U.S.C. §371 of PCT International Application No. PCT/JP99/01059 which has an International filing date of Mar. 5, 1999, which designated the United States of America.

FIELD OF THE INVENTION

This invention relates to an acid pickling device for washing and removing oxide scale, formed on the surface of a strip plate, by acid pickling.

BACKGROUND OF THE INVENTION

FIG. 4 is a perspective side view of a conventional acid pickling device, and FIG. 5 is a sectional view taken on line V—V in FIG. 4.

In the conventional acid pickling device, as shown in FIGS. 4 and 5, an acid pickling tank 101, which is open upwards, is filled with an acid liquid L for acid pickling of a strip steel plate S. A lid 102 is attached to the top of the acid pickling tank 101 to form an inlet portion 103, and an outlet portion 104. To the inlet portion 103 and the outlet portion 104, aerial deflector rolls 105, 106 and immersion deflector rolls 107, 108 are attached, respectively.

From a lower surface of the lid 102, a hook 109 is suspended. From the hook 109, a ceiling plate 111 is suspended via an engaging stop 110. From the ceiling plate 111, a bottom plate 113 is suspended via connecting plates 112 located at both side parts. On a lower surface of the ceiling plate 111, many immersion guide rolls 115 rotatable via bearing portions 114 are mounted along a direction of travel of the strip steel plate S. On an upper surface of the bottom plate 113, many skids 116 are attached at positions opposed to the immersion guide rolls 115.

Thus, the strip steel plate S is guided by the aerial deflector roll 105 and the immersion deflector roll 107 at the inlet portion 103 into the acid liquid L in the acid pickling tank 101, and travels, while being guided, between the immersion guide rolls 115 and the skids 116. At this time, oxide scale formed on the surface of the strip steel plate S is washed with the acid liquid L and removed thereby. Then, the strip steel plate S is guided by the immersion deflector roll 108 and the aerial deflector roll 106 at the outlet portion 104, and delivered to the outside of the acid pickling tank 101.

Such a conventional acid pickling device is disclosed, for example, in Japanese Unexamined Patent Publication No. 5-78870.

With the foregoing conventional acid pickling device, the acid liquid L is filled into the acid pickling tank 101 which is open upwards, and the lid 102 is attached to the top of the acid pickling tank 101. Thus, the surface area of the acid liquid L in the acid pickling tank 101 is so wide that a loss of acid becomes great as a result of evaporation. Consequently, the washing and removal of the oxide scale on the strip steel plate S by acid pickling are performed insufficiently.

Furthermore, the strip steel plate S travels, while being guided, between the immersion guide rolls 115 and the skids 116 in the acid pickling tank 101. Hence, as the strip steel plate S moves, the acid liquid L follows, and a flow of the acid liquid L toward a downstream side in the direction of travel of the strip steel plate S occurs. This makes the surface of the acid liquid L beside the outlet portion 104 higher, causing an overflow of the acid liquid L from the outlet portion 104 to the outside of the acid pickling tank 101. Besides, the many immersion guide rolls 115 and skids 116 that guide the travel of the strip steel plate S in the acid liquid L are suspended from and supported by the lid 102. Thus, a head weight acts on the lid 102, and may damage it.

SUMMARY OF THE INVENTION

The present invention attempts to solve the above problems. Its object is to provide an acid pickling device which suppresses a loss of an acid by decreasing a free surface of an acid liquid in an acid pickling tank, and prevents an overflow to the outside of the tank, thereby making acid pickling of a strip plate efficient.

The present invention is an acid pickling device for acid pickling a strip plate by causing the strip plate to travel in an acid pickling tank filled with an acid liquid while guiding the strip plate by an immersion guide roll and a skid, wherein an acid pickling tank lid for covering a top of the acid pickling tank is disposed such that a central part of the acid pickling tank lid is located at a lower position than a liquid level of the acid liquid in the acid pickling tank to cover a free surface of the acid liquid.

Thus, the surface area of the acid liquid in the acid pickling tank is narrower than in the earlier technology, thereby suppressing the loss of an acid due to evaporation, and ensuring reliable washing and removal of oxide scale on the strip plate by acid pickling. Moreover, the free surface of the acid liquid in the acid pickling tank is forcibly restrained, so that the liquid level of the acid liquid is held constant, thus preventing an overflow of the acid liquid to the outside of the tank. Consequently, the acid pickling of the strip plate can be performed efficiently.

The present invention also concerns the acid pickling device, wherein the immersion guide roll is provided on the acid pickling tank lid, and the skid is provided on a support block installed at the bottom of the acid pickling tank.

Thus, there is no need to suspend heavy materials from the lid, so that the lid can be decreased in rigidity, and can be made light-weight.

The present invention also concerns the acid pickling device, wherein the support block is provided with a bottom plate positioned below the skid and extending along a direction of travel of the strip plate.

Thus, as the strip plate moves in the acid pickling tank, the acid liquid follows, and is flowed downstream in the travel direction. As a result, the acid liquid is circulated, and becomes no more stagnant.

The present invention also concerns the acid pickling device, wherein a plurality of the immersion guide rolls and a plurality of the skids are provided, with predetermined spacing, in a direction of travel of the strip plate, the support block is provided with a bottom plate positioned below the skid and extending along the direction of travel of the strip plate, and the bottom plate is provided with acid liquid passages each located between the adjacent skids.

Thus, as the strip plate moves in the acid pickling tank, the acid liquid follows, generating a flow toward a downstream side in the travel direction. However, the flow of the acid liquid is circulated in the acid pickling tank through the acid liquid passages, thus eliminating stagnation of the acid liquid, and releasing the liquid pressure. Hence, it does not take place that the surface of the acid liquid suddenly becomes high, causing an overflow to the outside of the tank. In addition, the pressure imposed on the lid is also decreased, thus enabling the lid to be decreased in strength and be rendered light-weight.

The present invention also concerns the acid pickling device, wherein the acid liquid passages are each provided between the adjacent skids and upstream in the direction of travel of the strip plate.

Namely, the acid liquid passages are positioned just behind the site of passage of the strip steel plate between the immersion guide rolls and the skids. Thus, the static pressure of the acid liquid on the exit side progressively increases compared with the entrance side for the strip plate in the acid pickling tank. Hence, the acid liquid is agitated, and its circulation can be promoted.

The present invention also concerns the acid pickling device, wherein a plurality of the immersion guide rolls and a plurality of the skids are provided, with predetermined spacing, in a direction of travel of the strip plate, and communication holes for the acid liquid are provided in the support blocks that support the skids.

Thus, as the strip plate moves in the acid pickling tank, the acid liquid follows, generating a flow toward a downstream side in the travel direction. However, the flow of the acid liquid is circulated in the acid pickling tank through the communication holes, thus eliminating stagnation of the acid liquid, and releasing the liquid pressure. Hence, it does not take place that the surface of the acid liquid suddenly becomes high, causing an overflow to the outside of the tank. In addition, the pressure imposed on the lid is also decreased, thus enabling the lid to be decreased in strength and be rendered light-weight.

DETAILED DESCRIPTION OF THE INVENTION

A first embodiment of the present invention will now be described in detail by reference to the accompanying drawings.

Figure 1:
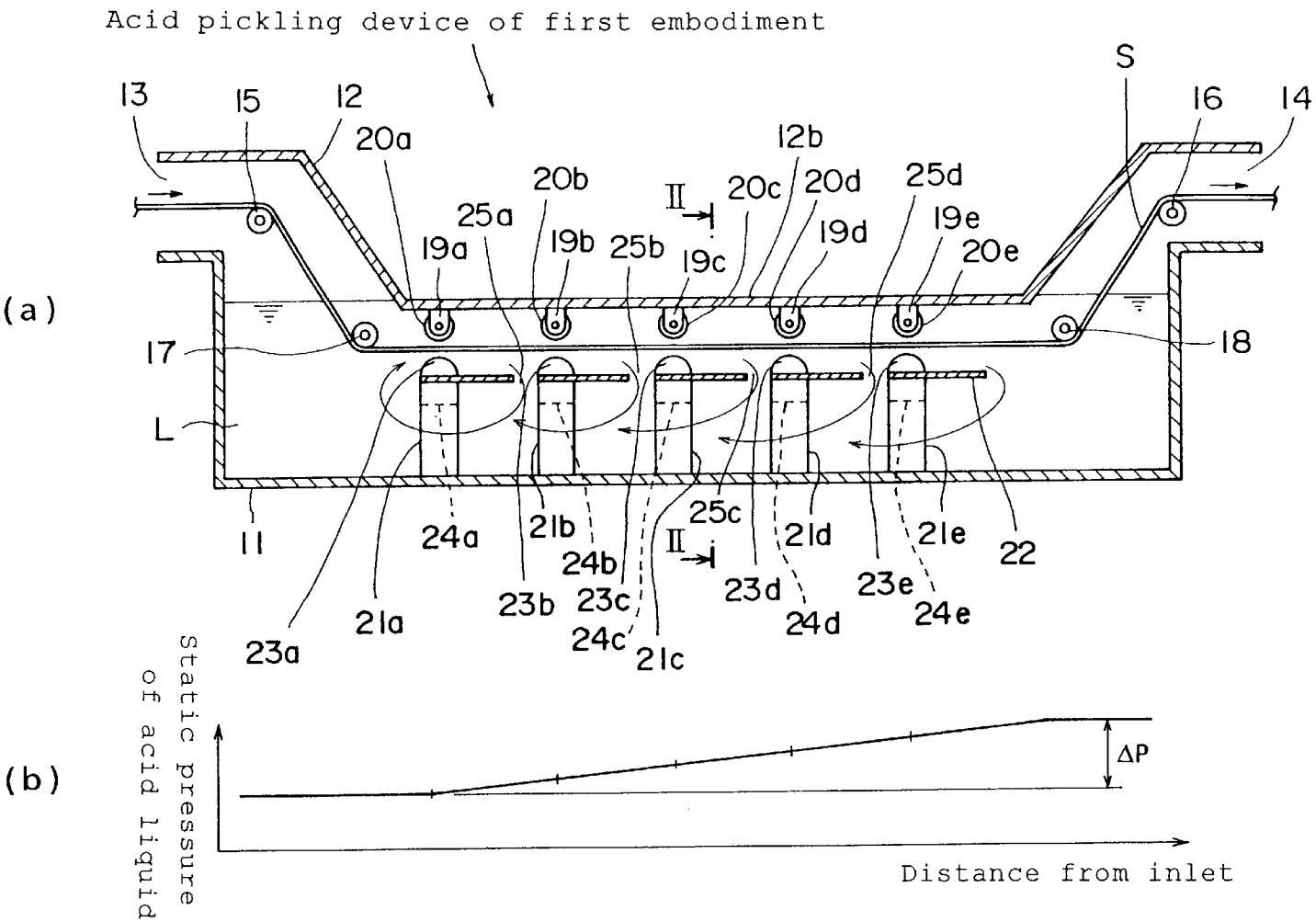
FIG. 1(*a*) is a schematic side view of an acid pickling device according to a first embodiment of the present invention, and FIG. 1(*b*) is a graph showing the static pressure distribution of an acid pickling liquid of the acid pickling device.
Figure 2:
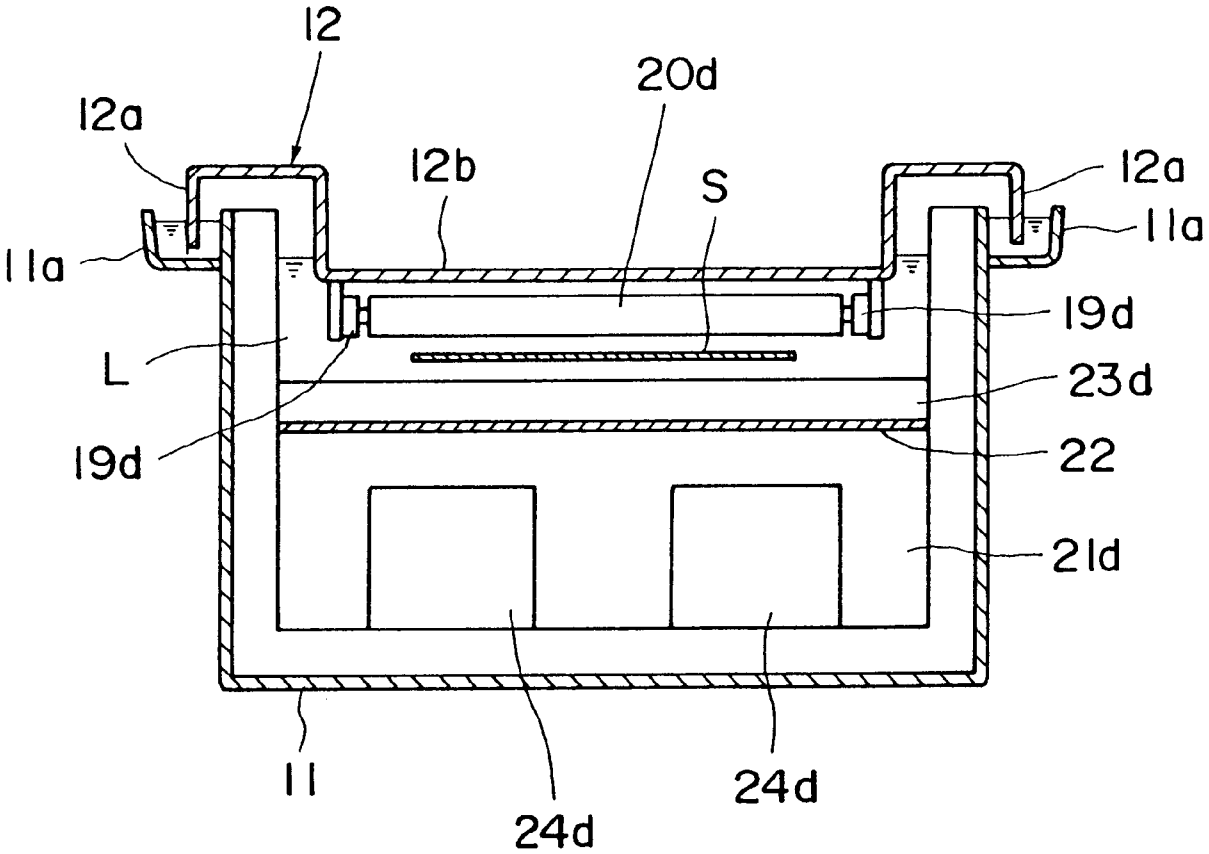
FIG. 2 is a sectional view taken along line II—II in FIG. 1(*a*)

In an acid pickling device of the first embodiment, as shown in FIG. 1(*a*) and FIG. 2, an acid pickling tank 11, which is open upwards, is filled with an acid liquid L for acid pickling of a strip steel plate S. A lid 12 is attached to an upper opening of the acid pickling tank 11 to form an inlet portion 13, and an outlet portion 14. The lid 12 has an outer peripheral flange portion 12*a* fitted liquid-tight into a receiver portion 11*a* formed at a side part of the acid pickling tank 11, and has a central part forming a covering portion 12*b* which is concaved downwardly. The covering portion 12*b* enters the acid liquid L in the acid pickling tank 11, and lies below the liquid level of the acid liquid. Thus, most of a free surface of the acid liquid L in the acid pickling tank 11 is covered with the covering portion 12*b* of the lid 12. To the inlet portion 13 and the outlet portion 14, aerial deflector rolls 15, 16 and immersion deflector rolls 17, 18 are attached, respectively.

On a lower surface of the covering portion 12*b* of the lid 12, immersion guide rolls 20*a* to 20*e* are rotatably mounted by a pair of (i.e., right and left) bearing portions 19*a* to 19*e* made of a metal (or resin, carbon or ceramic). This plurality of immersion guide rolls 20*a* to 20*e* are arranged parallel to each other, with predetermined spacing, along a direction of travel of the strip steel plate S. On a bottom surface of the acid pickling tank 11, a plurality of support blocks 21*a* to 21*e* are arranged in parallel along the direction of travel of the strip steel plate S. To the top of the support blocks 21*a* to 21*e*, a bottom plate 22 is fixed so as to connect the support blocks 21*a* to 21*e* together. To an upper surface of the bottom plate 22, a plurality of skids 23*a* to 23*e* are fixed at positions opposed to the immersion guide rolls 20*a* to 20*e*.

In the support blocks 21*a* to 21*e*, acid liquid communication holes 24*a* to 24*e*, through which the acid liquid L can flow, are formed. In the bottom plate 22, acid liquid passages 25*a* to 25*d*, through which the acid liquid L can flow, are each formed between the adjacent two of the skids 23*a* to 23*e* downstream in the direction of transport of the strip steel plate S. These acid liquid passages 25*a* to 25*d* are each in a slit, circular, or rectangular shape.

Thus, the strip steel plate S is guided by the aerial deflector roll 15 and the immersion deflector roll 17 at the inlet portion 13, and led into the acid liquid L of the acid pickling tank 11, where the strip steel plate S travels, while being guided, between the plurality of immersion guide rolls 20*a* to 20*e* and the plurality of skids 23*a* to 23*e*. During this occasion, oxide scale formed on the surface of the strip steel plate S is washed with and removed by the acid liquid L. Then, the strip steel plate S is guided by the immersion deflector roll 18 and the aerial deflector roll 16 of the outlet portion 14 to the outside of the acid pickling tank 11.

According to the acid pickling device of the present embodiment, the covering portion 12*b* in the central part of the lid 12 enters the acid liquid L in the acid pickling tank 11, and lies below the liquid level of the acid liquid. As a result, most of the free surface of the acid liquid L in the acid pickling tank 11 is covered with the covering portion. Thus, the surface area of the acid liquid L in the acid pickling tank 11 becomes smaller than in the earlier technology. Hence, a loss of an acid due to evaporation is decreased to ensure the reliable washing and removal of the oxide scale formed on the strip steel plate S by acid pickling.

In addition, as stated above, the covering portion 12*b* of the lid 12 enters the acid liquid L in the acid pickling tank 11, thereby forcibly restraining the free surface of the acid liquid L in the acid pickling tank 11, so that the liquid level of the acid liquid L can be kept constant.

Besides, the acid liquid communication holes 24*a* to 24*e*, through which the acid liquid L can flow, are formed in the support blocks 21*a* to 21*e*. In the bottom plate 22, the acid liquid passages 25*a* to 25*d*, through which the acid liquid L can flow, are formed. Thus, when the strip steel plate S travels, while being guided, between the immersion guide rolls 20*a* to 20*e* and the skids 23*a* to 23*e*, the acid liquid L follows the strip steel plate S as it moves. As a result, a downstream flow of the acid liquid L in the traveling direction of the strip steel plate S occurs. However, the acid liquid L does not wave, since its liquid level is restrained by the covering portion 12*b* of the lid 12. This flow of the acid liquid L moves downward through the acid liquid passages 25*a* to 25*d*, passes through the communication holes 24*a* to 24*e*, and is returned to an upstream side in the traveling direction of the strip steel plate S. In this manner, the acid liquid L circulates within the acid pickling tank 11. There is no stagnation of the acid liquid L, and the liquid pressure is released.

Hence, as shown in FIG. 1(*a*), a differential pressure Δp occurs in the acid liquid L between its pressure at the inlet portion 13 and that at the outlet portion 14 of the acid pickling tank 11. Hence, circulation of the acid liquid L is promoted, and it does not occur that the surface of the acid liquid L beside the outlet portion 14 suddenly rises, causing overflow of the acid liquid L to the outside of the acid pickling tank 11. Moreover, the liquid pressure in the acid pickling tank 11 is released, and does not increase. Thus, the strength of the lid 12 can be reduced.

Opposite the plural immersion guide rolls 20*a* to 20*e* suspended from the lid 12, the plural skids 23*a* to 23*e* are fixed to the bottom plate 22 on the plural support blocks 21*a* to 21*e* fixed to the bottom surface of the acid pickling tank 11. Thus, there is no need to suspend heavy materials from the lid 12, so that the rigidity of the lid 12 can be decreased, and it can be made lightweight.

Next, a second embodiment of the present invention will be described in detail by reference to the accompanying drawings. Members having the same functions as those explained in the aforementioned embodiment will be assigned the same numerals or symbols, and overlapping explanations will be omitted.

Figure 3:
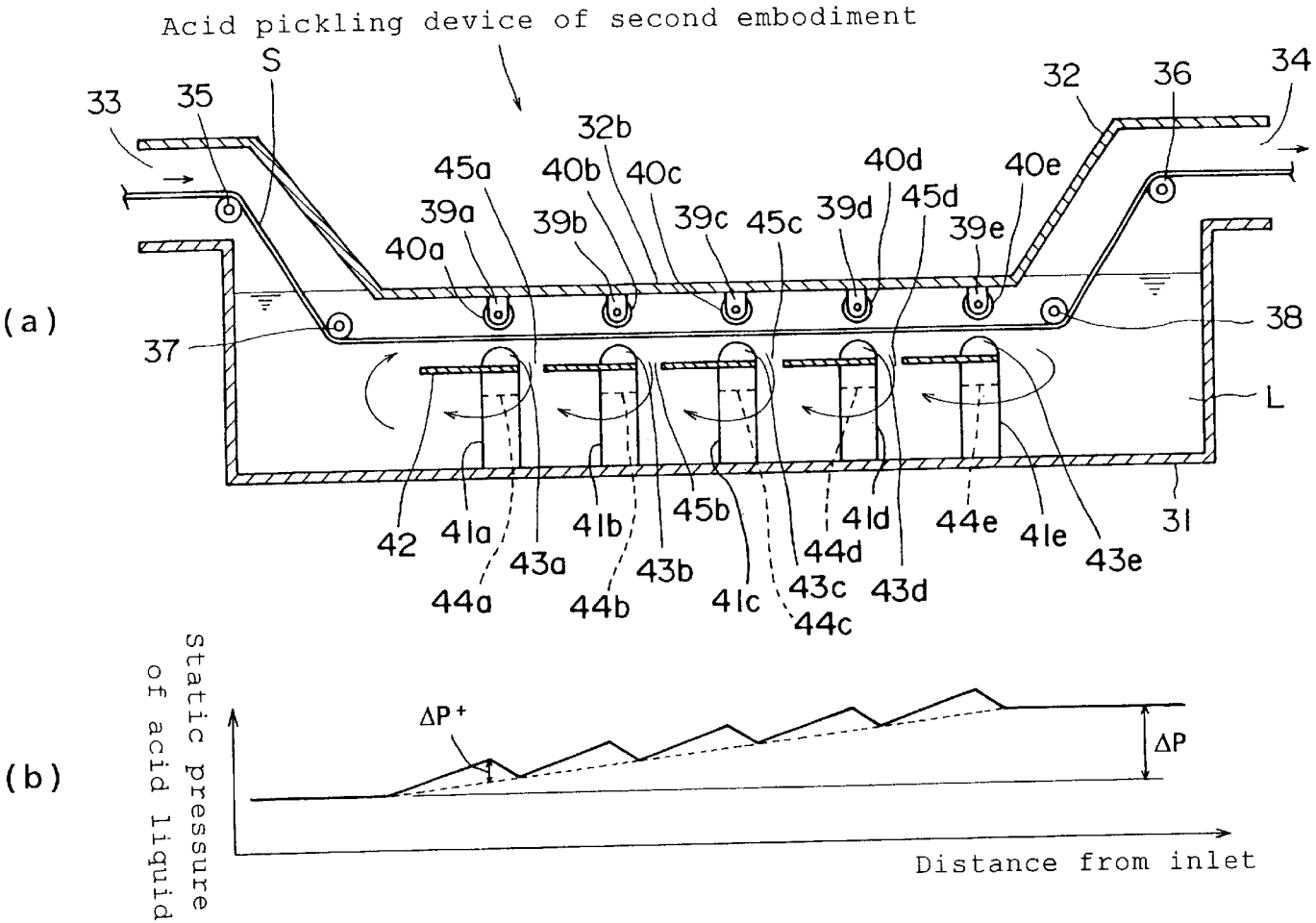
FIG. 3(*a*) is a schematic side view of an acid pickling device according to a second embodiment of the present invention, and FIG. 3(*b*) is a graph showing the static pressure distribution of an acid pickling liquid of the acid pickling device.
Figure 4:
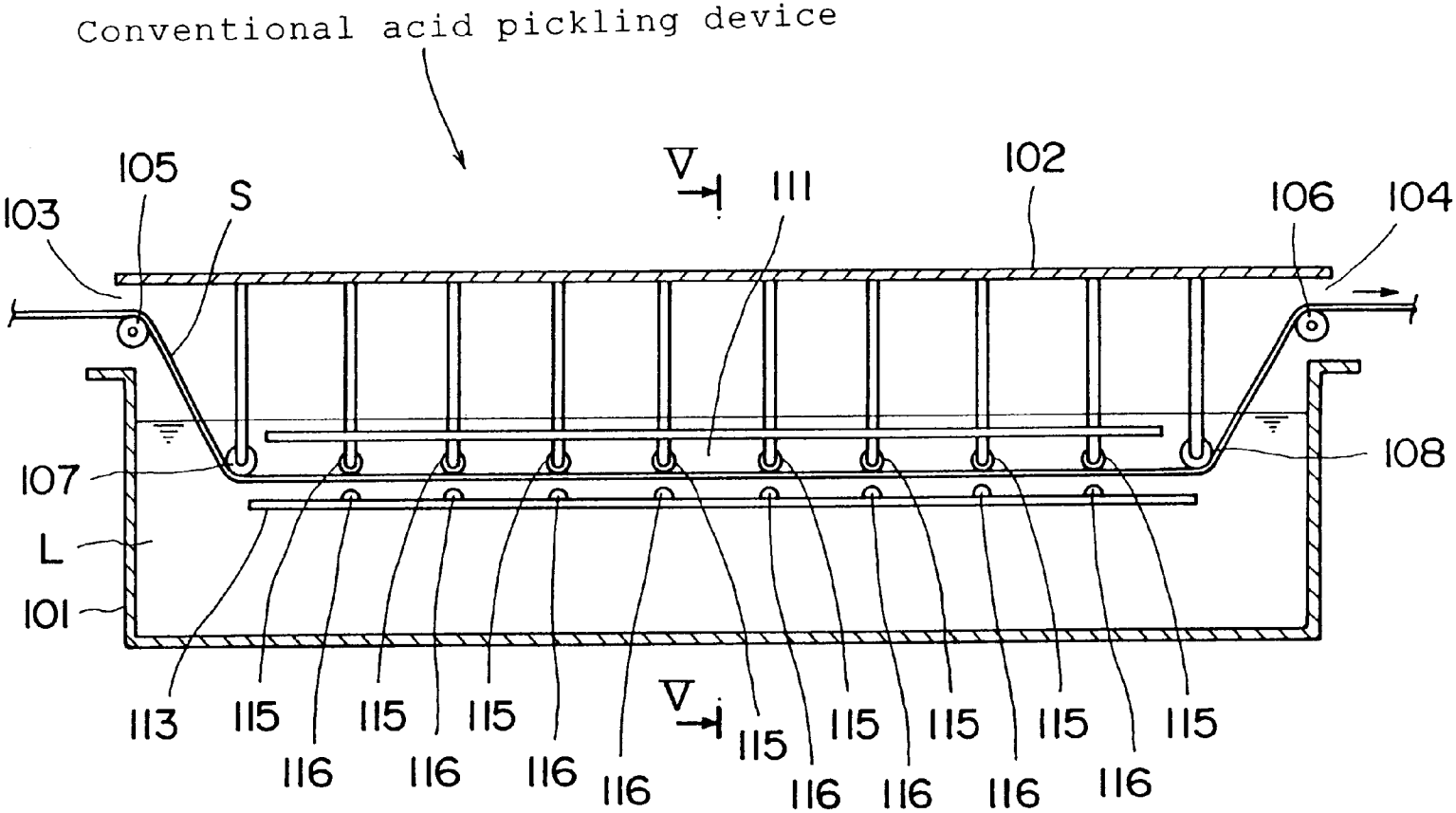
FIG. 4 is a schematic side view of a conventional acid pickling device.
Figure 5:
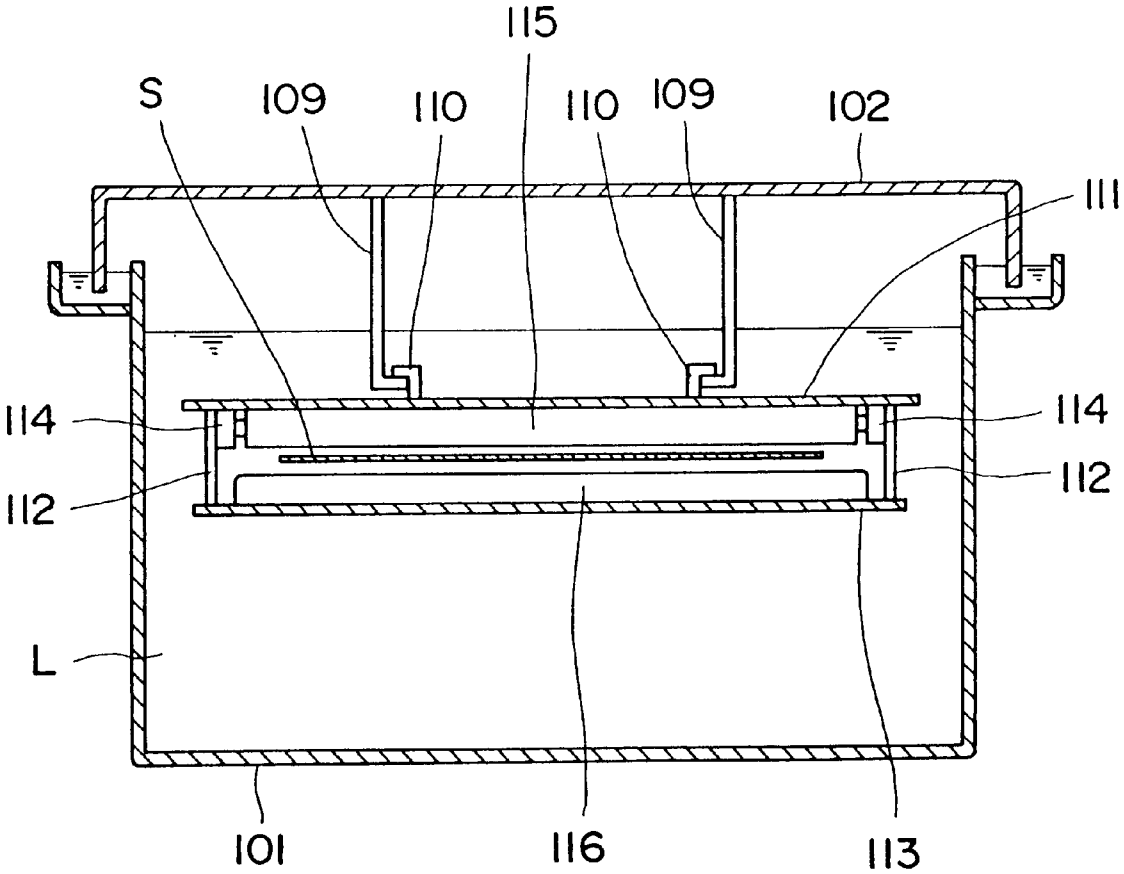
FIG. 5 is a sectional view taken along line V—V in FIG. 4.

In an acid pickling device according to the second embodiment, as shown in FIG. 3(*a*), an acid pickling tank 31, which is open upwards, is filled with an acid liquid L for acid pickling of a strip steel plate S. A lid 32 is attached to an upper opening of the acid pickling tank 31 to form an inlet portion 33, and an outlet portion 34. The lid 32 has a central part forming a covering portion 32*b* which is concaved downwardly. The covering portion 32*b* enters the acid liquid L in the acid pickling tank 31, and lies below the liquid level of the acid liquid. Thus, most of a free surface of the acid liquid L in the acid pickling tank 31 is covered with the covering portion 32*b* of the lid 32. To the inlet portion 33 and the outlet portion 34, aerial deflector rolls 35, 36 and immersion deflector rolls 37, 38 are attached, respectively.

On a lower surface of the covering portion 32*b* lid 32, immersion guide rolls 40*a* to 40*e* are rotatably mounted by bearing portions 39*a* to 39*e*. On a bottom surface of the acid pickling tank 31, a plurality of support blocks 41*a* to 41*e* are arranged in parallel along the direction of travel of the strip steel plate S. To the top of the support blocks 41*a* to 41*e*, a bottom plate 42 is fixed to connect the support blocks 41*a* to 4l*e* together. To an upper surface of the bottom plate 42, a plurality of skids 43*a* to 43*e* are fixed at positions opposed to the immersion guide rolls 40*a* to 40*e*.

In the support blocks 41*a* to 41*e*, acid liquid communication holes 44*a* to 44*e*, through which the acid liquid L can flow, are formed. In the bottom plate 42, acid liquid passages 45*a* to 45*d*, through which the acid liquid L can flow, are each formed between the adjacent two of the skids 43*a* to 43*e* upstream in the direction of transport of the strip steel plate S.

Thus, the strip steel plate S is guided by the aerial deflector roll 35 and the immersion deflector roll 37 at the inlet portion 33, and led into the acid liquid L of the acid pickling tank 31, where the strip steel plate S travels, while being guided, between the plurality of immersion guide rolls 40*a* to 40*e* and the plurality of skids 43*a* to 43*e*. During this occasion, oxide scale formed on the surface of the strip steel plate S is washed with and removed by the acid liquid L. Then, the strip steel plate S is guided by the immersion deflector roll 38 and the aerial deflector roll 36 of the outlet portion 34 to the outside of the acid pickling tank 31.

According to the acid pickling device of the present embodiment, the covering portion 32*b* of the lid 32 enters the acid liquid L in the acid pickling tank 31, and lies below the liquid level of the acid liquid. As a result, most of the free surface of the acid liquid L in the acid pickling tank 31 is covered with the covering portion. Thus, the surface area of the acid liquid L becomes small. Hence, a loss of the acid due to evaporation is decreased to ensure the reliable washing and removal of the oxide scale formed on the strip steel plate S by acid pickling. In addition, the free surface of the acid liquid L in the acid pickling tank 31 is forcibly restrained, so that the liquid level of the acid liquid L can be kept constant.

Besides, when the strip steel plate S travels, while being guided, between the immersion guide rolls 40*a* to 40*e* and the skids 43*a* to 43*e*, the acid liquid L follows the strip steel plate S as it moves. As a result, a downstream flow of the acid liquid L in the traveling direction of the strip steel plate S occurs. However, this flow of the acid liquid L moves downward through the acid liquid passages 45*a* to 45*d*, passes through the communication holes 44*a* to 44*e*, and is returned to an upstream side in the transport direction of the strip steel plate S. In this manner, the acid liquid L circulates within the acid pickling tank 31. This eliminates stagnation of the acid liquid L, and releases the liquid pressure. Hence, as shown in FIG. 3(*a*), a differential pressure Δp occurs in the acid liquid L between its pressure at the inlet portion 33 and that at the outlet portion 34 of the acid pickling tank 31. Also, the differential pressure progressively increases owing to a load pressure $\Delta p^{+}$, thus promoting circulation of the acid liquid L. This is because the acid liquid passages 45*a* to 45*d* are located at positions just behind the site of passage of the strip steel plate S between the immersion guide rolls 40*a* to 40*e* and the skids 43*a* to 43*e*. Thus, agitation of the acid liquid L is promoted. On the other hand, it does not occur that the surface of the acid liquid L beside the outlet portion 34 suddenly rises, causing overflow of the acid liquid L to the outside of the acid pickling tank 31. Moreover, the liquid pressure in the acid pickling tank 31 is released, and does not increase. Thus, the strength of the lid 32 can be reduced.

In each of the above-described embodiments, the central part of the lid 12 or 32 was rendered concaved downwardly to form the covering portion 12*b* or 32*b*. However, a separate member may be provided on the lower surface of the lid 12 or 32 to form the covering portion 12*b* or 32*b*. Furthermore, the numbers of the immersion guide rolls 20*a* to 20*e* or 40*a* to 40*e*, and the skids 23*a* to 23*e* or 43*a* to 43*e* are not restricted to those described in the embodiments.

As described above, the acid pickling device of the present invention immerses a strip plate in an acid pickling tank to wash and remove oxide scale, formed on the surface of the strip plate, by acid pickling. This device is preferred for use in a surface treating device for treating a continuously traveling strip plate at a high speed.

What is claimed is:

1. An acid pickling device for acid pickling a strip plate by causing the strip plate to travel in an acid pickling tank filled with an acid liquid, comprising:

an immersion guide roll for guiding the strip plate while the strip plate travels in the acid pickling tank, said immersion guide roll being provided on the acid pickling tank lid;

a skid for guiding the strip plate while the strip plate travels in the acid pickling tank, said skid being provided on a support block installed at a bottom of the acid pickling tank; and an acid pickling tank lid for covering a top of the acid pickling tank, a central part of the acid pickling tank lid being located at a lower position than a liquid level of the acid liquid in the acid pickling tank such that the lid covers a free surface of the acid liquid, wherein the support block is provided with a bottom plate positioned below the skid and extends along a direction of travel of the strip plate.

2. The acid pickling device of claim 1, wherein a plurality of the immersion guide rolls and a plurality of skids are provided, with predetermined spacing, in a direction of travel of the strip plate, and communication holes for the acid liquid are provided in the support blocks that support the skids.

3. An acid pickling device for acid pickling a strip plate by causing the strip plate to travel in an acid pickling tank filled with an acid liquid, comprising:

a plurality of immersion guide rolls for guiding the strip plate while the strip plate travels in the acid pickling tank, said immersion guide rolls being provided on the acid pickling tank lid, with a predetermined spacing, in a direction of travel of the strip plate;

a plurality of the skids for guiding the strip plate while the strip plate travels in the acid pickling tank, said skids being provided, with the predetermined spacing, in the direction of travel of the strip plate; and an acid pickling tank lid for covering a top of the acid pickling tank, a central part of the acid pickling tank lid being located at a lower position than a liquid level of the acid liquid in the acid pickling tank such that the lid covers a free surface of the acid liquid, wherein the support block is provided with a bottom plate positioned below the skid and extends along a direction of travel of the strip plate, and wherein the support block is provided with a bottom plate positioned below the skids and extending along the direction of travel of the strip plate, and the bottom plate is provided with acid liquid passages each located between the adjacent skids.

4. The acid pickling device of claim 3, wherein the acid liquid passages are each provided between the adjacent skids and upstream in the direction of travel of the strip plate.

* * * * *

UNITED STATES PATENT AND TRADEMARK OFFICE

CERTIFICATE OF CORRECTION

PATENT NO. : 6,340,028 B1
DATED : January 22, 2002
INVENTOR(S) : Etsuro Hirai et al.

It is certified that error appears in the above-identified patent and that said Letters Patent is hereby corrected as shown below:

Title page,
Item [56], References Cited, FOREIGN PATENT DOCUMENTS, please delete the duplicate citation of
"JP 2133589 5/1990"
and insert therefor the following citation which was missing
-- JP 5-78874A 3/1993 --.

Signed and Sealed this

Fifth Day of November, 2002

*Attest:*

*Attesting Officer*

JAMES E. ROGAN
*Director of the United States Patent and Trademark Office*